US005330058A

United States Patent [19]

Rice

[11] Patent Number: 5,330,058

[45] Date of Patent: Jul. 19, 1994

[54] OPEN-FRAME RACK FOR SELF-SERVICE VENDING OF EVERGREENS

[76] Inventor: Everett Rice, 4094 Terrance Ct., Fort Gratiot, Mich. 49054

[21] Appl. No.: 123,643

[22] Filed: Sep. 17, 1993

[51] Int. Cl.[5] ..... A47F 5/00

[52] U.S. Cl. ..... 211/4; 211/189; 211/194; 312/257.1; 312/265.4

[58] Field of Search ..... 211/4, 189, 194, 191, 211/60.1; 312/257.1, 265.1, 265.4

[56] References Cited

U.S. PATENT DOCUMENTS

| | | | |
|---|---|---|---|
| 688,819 | 12/1901 | Ballard . | |
| 1,473,817 | 11/1923 | Gorsline | 312/265.1 X |
| 1,925,199 | 9/1933 | Mills . | |
| 1,983,307 | 12/1934 | Regenhardt | 312/257.1 |
| 2,463,658 | 3/1949 | Thrasher . | |
| 3,346,316 | 10/1967 | Morioka et al. | 312/265.4 |
| 3,575,478 | 4/1971 | Szobski et al. . | |
| 3,717,395 | 2/1973 | Spielvogel et al. . | |
| 3,790,244 | 2/1974 | Stackhouse . | |
| 4,423,913 | 1/1984 | Lee . | |
| 4,592,601 | 6/1986 | Hlinsky et al. | 312/257.1 X |
| 5,154,497 | 10/1992 | Smith . | |

*Primary Examiner*—Robert W. Gibson, Jr.
*Attorney, Agent, or Firm*—Peter D. Keefe

[57] ABSTRACT

An open-frame rack which affords self-service sales of evergreen merchandise, thereby avoiding the necessity of an attendant at the display site. The open-frame rack is composed of a frame structure having interlocking stories. Each story is composed of multiple compartments which may be structured for the sale of Christmas trees and/or grave blankets and/or wreathes. Each compartment is provided with a customer access door which has a key retaining key-lock. The customer access door is by the customer to remove the evergreen merchandise contained in the respective compartment after the customer has paid therefor. It is preferred for the compartments containing large evergreen merchandise, such as Christmas trees, to be further provided with a merchant access door which has a conventional key-lock operable only by the merchant, the access door providing for stocking of the compartments so equipped. The open frame rack is structured so as to prevent theft of the evergreen merchandise, allow customers to see the evergreen merchandise when making a selection, and affords the weather full life-sustaining access to the evergreens.

19 Claims, 5 Drawing Sheets

OPEN-FRAME RACK FOR SELF-SERVICE VENDING OF EVERGREENS

BACKGROUND OF THE INVENTION

1. Field of the invention

The present invention relates to racks for the display of merchandise, and more particularly to a display rack structured to provide self-service vending of the merchandise. Still more particularly, the present invention relates to a rack of the aforesaid class having an open frame structure for suitably allowing for the storage therein of evergreen merchandise, which merchandise requires intimate contact with the outside weather in order to remain merchantable over a reasonable period of time.

2. Description of the Prior Art

Christmas trees, grave blankets and wreaths are all of the evergreen family and are conventionally sold via an outside display where the evergreen merchandise is individually and separately arranged over a display area outside. The evergreen merchandise is kept outdoors so that the local weather can reach the evergreens and thereby impart moisture (from due, rain, snow etc.), sun and to the still living components thereof. Because of the aforesaid display arrangement, it is necessary to have at least one attendant at all times in order to handle each sale individually. This is costly and involves a high overhead which must be passed on to the customers.

Accordingly, what is needed in the art is a way to evergreen merchandise without the necessity of an attendant at the display site.

SUMMARY OF THE INVENTION

The present invention is an open-frame rack which affords self-service sales of evergreen merchandise, thereby avoiding the necessity of an attendant at the display site.

The open-frame rack according to the present invention is composed of a frame structure having interlocking stories. Each story is composed of multiple compartments which may be structured for the sale of Christmas trees and/or grave blankets and/or wreathes. Each compartment is provided with a customer access door which has a key retaining key-lock. The customer access door is utilized by the customer to remove the evergreen merchandise contained in the respective compartment after the customer has paid therefor. It is preferred for the compartments containing large evergreen merchandise, such as Christmas trees, to be further provided with a merchant access door which has a conventional key-lock operable only by the merchant, the access door providing for stocking of the compartments so equipped.

The open frame rack is structured so as to prevent theft of the evergreen merchandise, allow customers to see the evergreen merchandise when making a selection, and affords the weather full life-sustaining access to the evergreens.

In operation, the customer inspects the evergreen merchandise and then makes a selection. The customer then tells the merchant which compartment holds his choice. After payment therefor, the merchant gives the customer a key to the key retaining key-lock of the customer access door of the selected compartment. The user then uses the key to open the key retaining key-lock and thereupon gain entry into the selected compartment so as to remove the merchandise therefrom.

The key is retained in the key lock until the merchant releases it.

Accordingly, it is an object of the present invention to provide self-service sales of evergreen merchandise, It is an additional object of the present invention to provide an open-frame rack which affords the evergreen merchandise contained therein life sustaining access to the weather surrounding the open-frame rack.

It is a further object of the present invention to provide an open-frame rack which affords the evergreen merchandise contained therein life sustaining access to the weather surrounding the open-frame rack, wherein the open-framed rack is individually compartmentalized so that merchandise in any one compartment may be accessed by a customer.

It is another object of the present invention to provide an open-frame rack which affords the evergreen merchandise contained therein life sustaining access to the weather surrounding the open-frame rack, wherein the open-framed rack is individually compartmentalized so that merchandise in any one compartment may be accessed by a customer, wherein access is accomplished by a key retaining key-lock wherein the key is retained in the key retaining key-lock until the merchant releases it.

It is yet a further object of the present invention to provide an open-frame rack which affords the evergreen merchandise contained therein life sustaining access to the weather surrounding the open-frame rack, wherein the open-frame rack is constructed of multi-compartment stories, adjacent stories mutually interlocking together.

It is still another object of the present invention to provide an open-frame rack which affords the evergreen merchandise contained therein life sustaining access to the weather surrounding the open-frame rack, wherein set-up and break-down of the open-frame rack is easily and simply accomplished.

It is yet another object of the present invention to provide an open-frame rack which affords the evergreen merchandise contained therein life sustaining access to the weather surrounding the open-frame rack, wherein set-up and break-down of the open-frame rack is easily and simply accomplished via an interlocking post-and-pin construction which requires no fasteners.

It is yet an additional object of the present invention to provide an open-frame rack which affords the evergreen merchandise contained therein life sustaining access to the weather surrounding the open-frame rack, wherein Christmas trees, grave blankets and wreaths may be sold in a self-service manner.

It is yet another object of the present invention to provide an open-frame rack which affords the evergreen merchandise contained therein life sustaining access to the weather surrounding the open-frame rack, wherein Christmas trees, grave blankets and wreaths may be sold in a self-service manner, wherein further the merchant has exclusive access to at least some of the compartments for stocking the evergreen merchandise therein.

These, and additional objects, advantages, features and benefits of the present invention will become apparent from the following specification.

DETAILED DESCRIPTION OF THE PREFERRED EMBODIMENT

Figure 1:
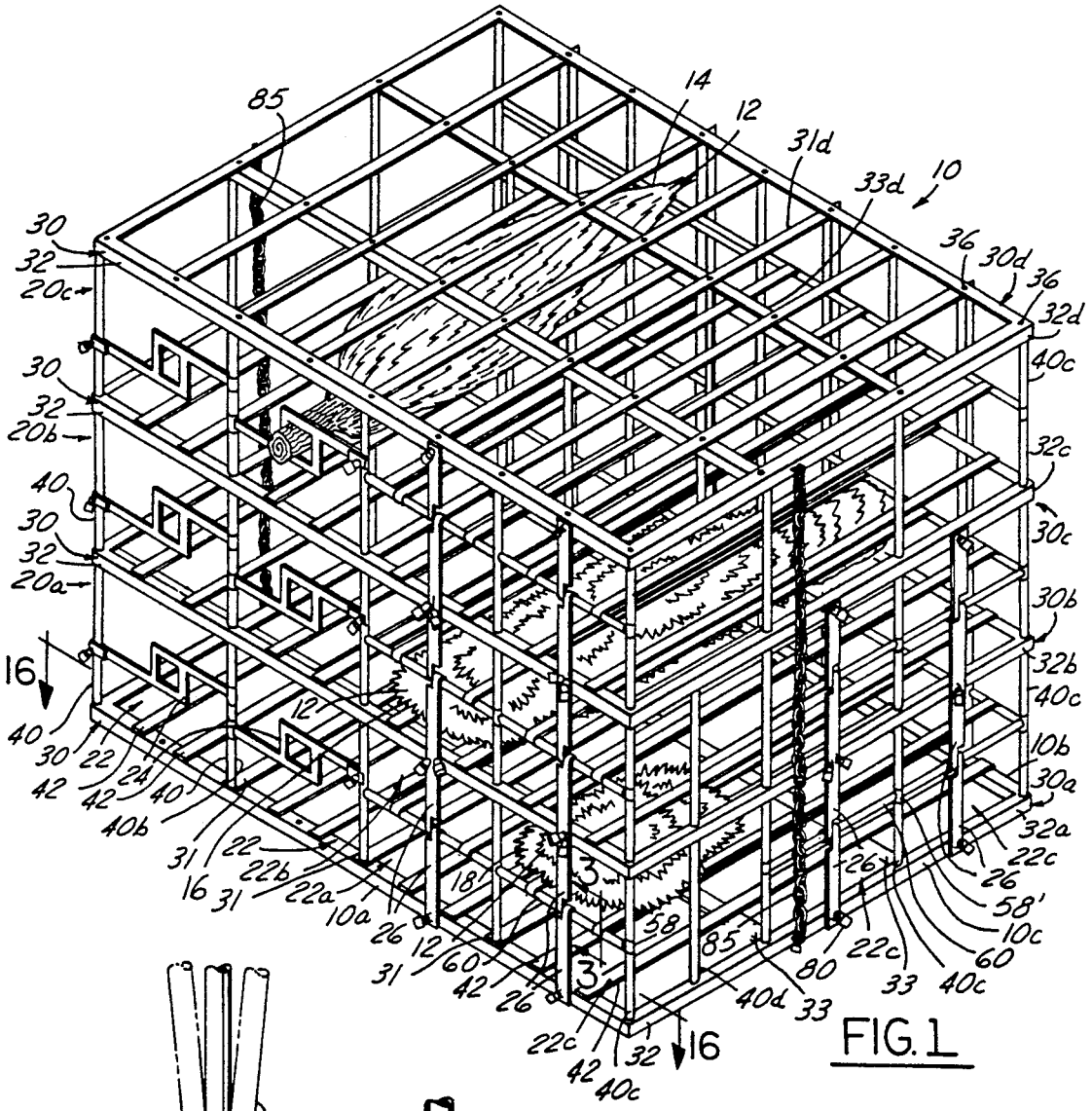
FIG. 1 is a perspective view of the open-frame rack according to the present invention shown in operation with evergreen merchandise.

Referring now to the Drawing, FIG. 1 shows the open-frame rack 10 in operation for self-service vending of evergreen merchandise 12, such as for instance Christmas trees 14, grave blankets 16 and wreaths 18. In order for the evergreen merchandise 12 to stay merchantable for as long a time as possible, it is necessary to provide the foliage of the evergreen merchandise access to the outdoors in order for the foliage to breathe, absorb moisture and receive sunlight. The open-frame rack 10 accomplishes this by a widely spaced frame structure which is kept minimized only sufficient for structural integrity and deterrence against theft of the evergreen merchandise 12. Importantly, the open-frame rack 10 is constructed using a post-and-pin construction in which the open-frame rack is sequentially assembled one floor at a time without the need of fasteners. The post-and-pin construction affords minimization of set-up and tear-down time; further, the open-frame rack 10 can be disassembled into a very compact package which minimizes storage volume and expense during the off-season and makes transportation to a sales location possible with a pick-up truck.

As can be discerned by reference to FIG. 1, the open-frame rack 10 is constructed of preferably three stories: a first story 20*a*, a second story 20*b*, and a third story 20*c*. Each story is subdivided into compartments 22. Each compartment 22 is preferably two feet by two feet by six feet from the front side 10*a* of the open-framed rack to the rear side 10*b* thereof. In the preferred example of the open-framed rack 10 there are four compartments 22 per story 20*a*, 20*b*, 20*c*. The front 10*a* of the open-faced rack 10 is provided with key-operated first customer access doors 24 for a customer to obtain his or her merchandise. With respect to large evergreen merchandise 12 such as Christmas trees 14, one such item of merchandise is resident in each compartment 22. In the case of lesser voluminous evergreen merchandise, such as grave blankets 16, it is preferred to bisect the compartments 22 used therefor into two portions: a main portion 22*a* having a main floor and a mezzanine portion 22*b* having a mezzanine floor. The front 10*a* of the open-faced rack 10 is provided with key-operated second customer access doors 26 for a customer to obtain his or her merchandise from either the main or the mezzanine portions 22*a*, 22*b*, exclusively. With respect to small evergreen merchandise 12 such as wreaths 18, it is preferred to further subdivide the aforementioned bisected compartments into cells 22*c*. Each cell 22*c* is provided with an aforementioned key-operated second customer access door 26.

Now with reference being additionally directed to remaining FIGS. 2 through 18, the structure and function of the open-frame rack 10 will be detailed with greater specificity.

Each story 20*a*, 20*b*, 20*c* is defined by adjacent vertical stacking of pre-assembled floors 30, including: a first floor 30*a*, a second floor 30*b*, a third floor 30*c* and a fourth floor 30*d*. Each floor 30 includes a perimeter frame 32, including: a first perimeter frame 32*a* for the first floor 30*a*, a second perimeter frame 32*b* for the second floor 30*b*, a third perimeter frame 32*c* for the third floor 30*c*, and a fourth perimeter frame 32*d* for the fourth floor 30*d*. The perimeter frames 32 are preferably constructed of angle stock that is spot welded together at each of the corners thereof. Each floor 30 further includes beams 31, each beam running along, and defining, the intersection of adjoining compartments 22 and two equidistantly spaced cross-beams 33 which are oriented transverse to the beams 31. Preferably, the beams 31 and cross-beams 33 are constructed of flat stock which is welded to the perimeter frame 32. Holes 34 are provided in each of the perimeter frame 32, beams 31 and cross-beams 33 at locations whereat a pin 36 or 38 (see FIGS. 12 and 14) is inserted thereinto, the pin used depending on the placement of the floor 30, as will be detailed hereinbelow. The holes 34 are preselected to define the location of posts 40 and thereby the location of the compartments 22. The posts 40 define the height of each story, and serve as load bearing and merchandise captivating structures. A plurality of runners 42, preferably constructed of flat stock, are connected with the perimeter frame 32 such as by welding, from the front side to the rear side thereof (as defined by the front side 10*a* and rear side 10*b* of the open-framed rack 10 when installed as a component thereof). In this regard, a pair of runners 42 are equidistantly spaced within each compartment 22 so as to form a base for supporting evergreen merchandise in each compartment.

Figure 2:
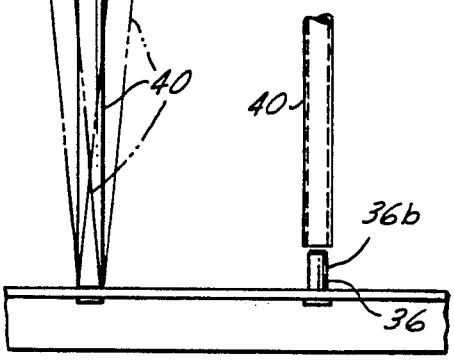
FIG. 2 is a partly broken, side view of the post-and-pin construction of the open-frame rack.

The perimeter frame 32*a* of the first floor 30*a* is provided with permanently attached single-shank pins 36, having a head 36*a* and a shank 36*b*, as shown in FIGS. 2, 13, 17 and 18. The single-shank pins 36 are preferably constructed of a structural plastic and are press fit into each of the holes 34 of the perimeter frame 32*a*, as shown in FIG. 2. The first floor 30*a* is laid upon the ground, and a first set of the posts 40, which are provided with hollow ends (preferably via the posts being of plastic tubular construction) are placed upon the shanks 36*b*, again as shown in FIG. 2. While the shanks 36*b* hold the posts 40 upright, there is some degree of wobbling of the posts possible. The posts 40 include simply constructed posts 40*a* which are utilized wherever there is no need to connect any additional structures thereto (see FIG. 1). The posts 40 also include first customer access door support posts 40*b*, mezzanine floor support posts 40*c*, and cell defining posts 40*d*, as will be detailed hereinbelow.

Figure 8:
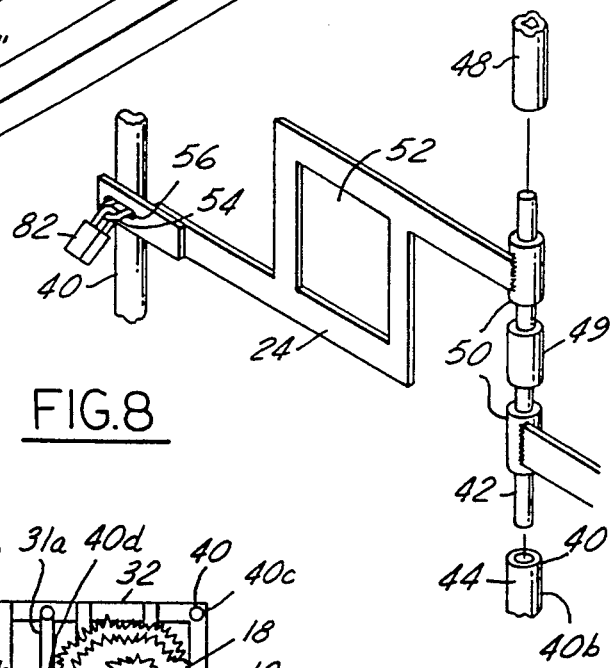
FIG. 8 is a detail, partly broken perspective view of the customer access doors for large evergreen merchandise.
Figure 15:
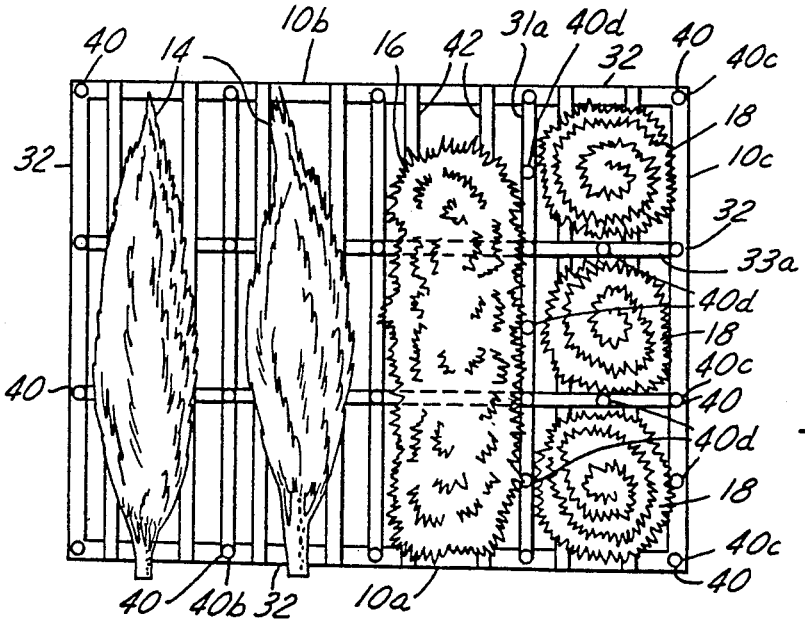
FIG. 15 is a plan view of a floor of the open-frame rack according to the present invention, shown in operation with respect to evergreen merchandise.
Figure 9:
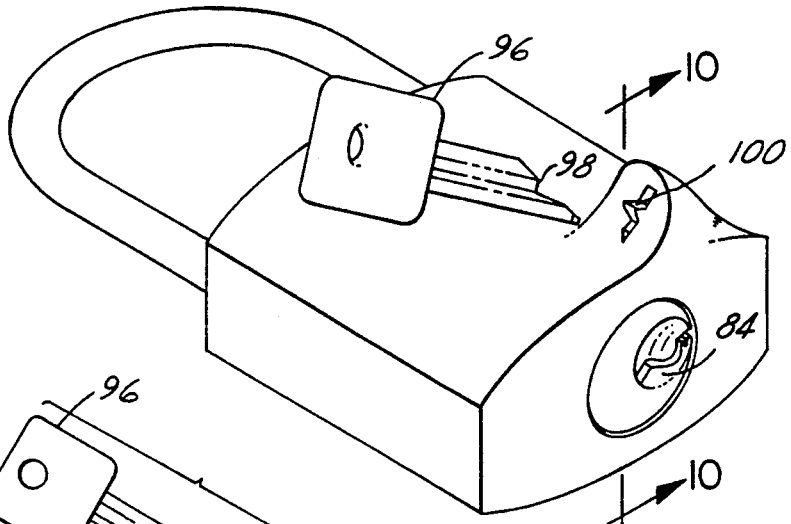
FIG. 9 is a perspective view of a key retaining key-lock according to the present invention.

The first customer access door support posts 40*b*, as depicted in FIG. 8, are constructed of a lower section 44, a pin 46 and an upper section 48. The pin 46 is received by hinge mounts 50 on each of two first customer access doors 24, and is received in each of the upper section 48 and the lower section 46. A spacer 49 may be optionally provided to adjust the relative vertical positioning of adjacent first customer access doors 24. Accordingly, the upper and lower sections 44, 48 are interconnected by the pin 46, which pivotally supports one or two (two being depicted in the Drawing) first customer access doors 24. The first customer access doors 24 are structured to span between adjacent posts 40. Preferably, the first customer access door 24 is more-or-less Z-shaped, having a medially located trunk aperture 52 for accepting therein the trunk of a Christmas tree 14, as shown in FIG. 1. The posts 40 adjacent the first customer access door support posts 40*b* are provided with a U-shaped ring 54 which is dimensioned to be received through a latch slot 56 in the first customer access door opposite the hinge mount 50 thereof.

The construction of the mezzanine floors will now be detailed with the aid of FIGS. 1, 3, 6 and 7.

Figure 7:
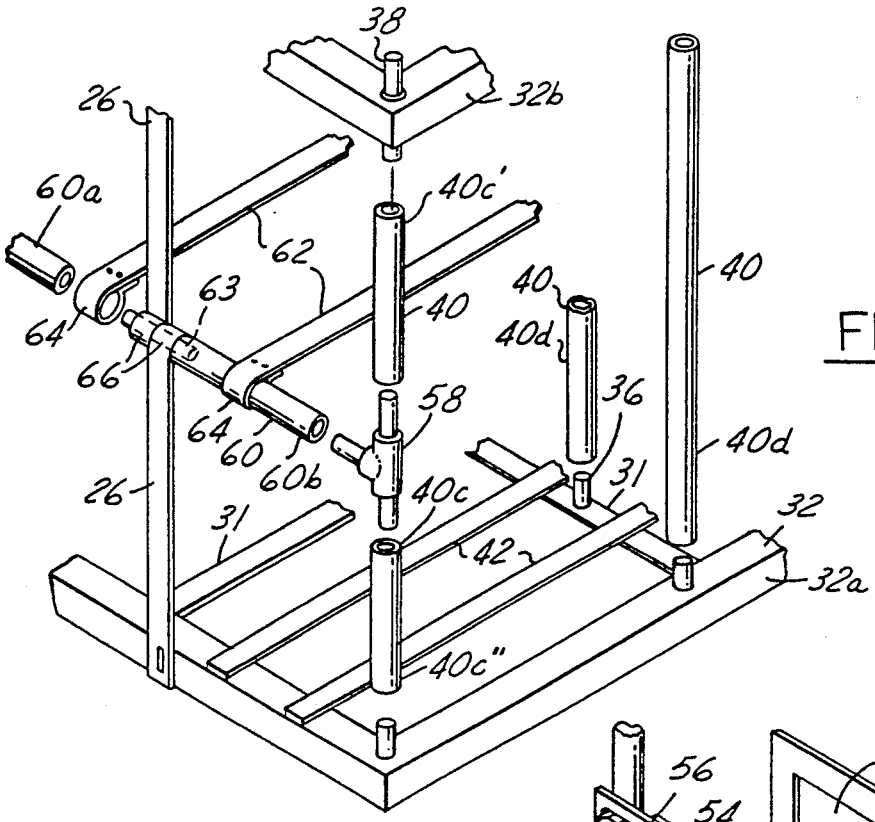
FIG. 7 is an exploded perspective view of the open-frame rack, showing the post-and-pin construction according to the present invention.

As can be discerned from FIG. 7, the mezzanine floor support posts 40*c* are composed of an upper part 40*c*' and a lower part 40*c*'' which are confined by a medially located floor support connector 58 having shanks which are dimensioned to fit into the posts 40*c*. A mezzanine floor member 60 interconnects with adjacent floor support connectors 58 insertably at each end thereof. The shanks of the floor support connector 58 also fit into the mezzanine floor member 60, and the orientation of the shanks may be configured in a T-shape, cross-shaped (wherein the shanks thereof lie on the plane established by all four shanks), or pseudo-cross-shaped (wherein one shank thereof is normal to the plane established by the other three shanks thereof), as requested.

Figure 3:
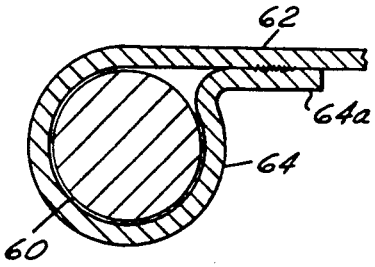
FIG. 3 is a detail sectional end view of the open-frame rack showing a portion of the mezzanine floor construction, taken along line 3—3 in FIG. 1.

The aforementioned wobbling of the posts 40 permits the installer to easily manipulate the upper and lower parts of the mezzanine support posts 40*c* to insert into the appropriate pin 36, 38 and the shanks of the floor support connectors 58. The front side and rear side mezzanine floor members 60 (as defined by the front side 10*a* and rear side 10*b* of the open-frame rack 10) are connected with a pair of mezzanine runners 62, preferably by a C-shaped connection 64 which slips over the mezzanine floor member, as shown in FIG. 3. In this regard, it is preferred for a portion 64*a* of the C-shaped connection 64 to be spot welded to its runner 62.

Figure 6:
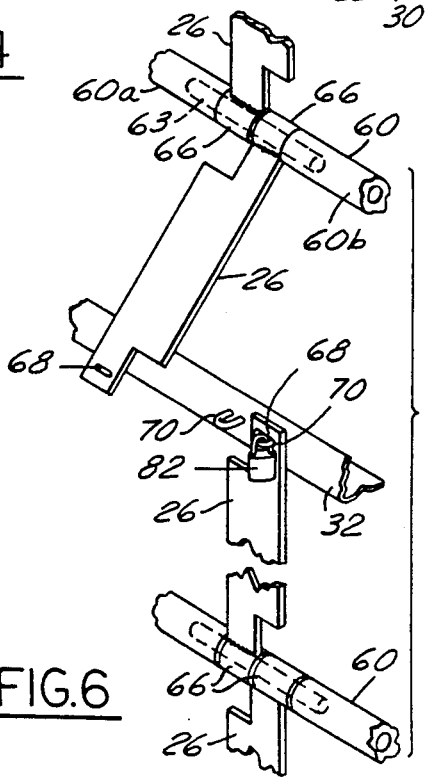
FIG. 6 is a detail, partly broken perspective view of the customer access doors for small evergreen merchandise.

As shown in FIG. 6, the second customer access doors 26 are pivotally connected with the mezzanine floor members 60 whereat customer access is desired (see FIG. 1). Preferably, the pivotal connection thereof is via a collar 66 connected with the second customer access door 26. Preferably, the second customer access doors 26 are constructed of flat stock which vertically spans the cell 22*c*. The end of the second customer access door opposite the collar 66 has a slot 68 into which a ring 70 is received, wherein the ring 70 is connected with the perimeter frame 32 vertically adjacent the mezzanine floor member 60 upon which the collar pivots. It should be noted that the front cells 22*c* have their second customer access door 26 at the front side 10*a* of the open-frame rack 10, so cell defining posts 40*d* must be provided in order to ensure that the wreathes 18 are not subject to theft by being able to slip it between the posts (see FIG. 15). Preferably, the mezzanine floor members 60 are sectionalized into a first mezzanine floor member 60*a* and a second mezzanine floor member 60*b* with a door connector 63 being received therebetween so as to conjoin the first and second mezzanine floor members and provide reduced diameter portions for receiving, respectively, the collars 66 so as to positionally locate the second customer access doors 26 relative thereto.

Now, the assembly of the stories of the open-framed rack 10 will be elaborated further.

With regard to assembly of the first story 20*a*, once the first floor 30*a* has been placed upon the ground, a first set of posts 40 placed in the shanks 36*b* of the single-shank pins 36, the first customer access doors 24 installed, the mezzanine floor members 60 installed with their associated mezzanine runners 62 and second customer access doors 26 installed, then the second floor 30*b* is ready to be installed. The posts 40 are wobbled to align each with a corresponding hole 34 in the second perimeter frame 32*b* and associated beams and cross-beams of the second floor 30*b*. Next, double-shank pins 38 (see FIG. 14) are placed so that the lower shank 38*a* thereof goes through each hole 34 so as to abut the annular flange 38*b* thereof with the perimeter frame 32*b*, beam or cross-beam as the case may be. In this regard, the lower shank 38*a* enters into the first set of posts 40 of the first story, while the upper shank 38*c* will be utilized to receive a second set of posts 40 of the second story in the manner described with respect to the first story.

The second and third stories are assembled as the steps described hereinabove are repeated, now using second and third sets of posts 40, respectively, wherein the third floor 30*c* has a third perimeter frame 32*c* and the fourth floor 30*d* has a fourth perimeter frame 32*d*. One structural note is that the third floor 30*d* atop the third story is terminal in the preferred example. Accordingly, it is preferred to utilize the single-shank pins 36, wherein the single shank pins are permanently connected with the holes 34 in the fourth perimeter frame 32*d*, the fourth beams 31*d* and the fourth cross-beams 33*d* thereof, but facing oppositely as they do on the perimeter frame 32*a*, the first beams 31*a* and the first cross-beams 33*a* of the first floor 30*a*.

Figure 4:
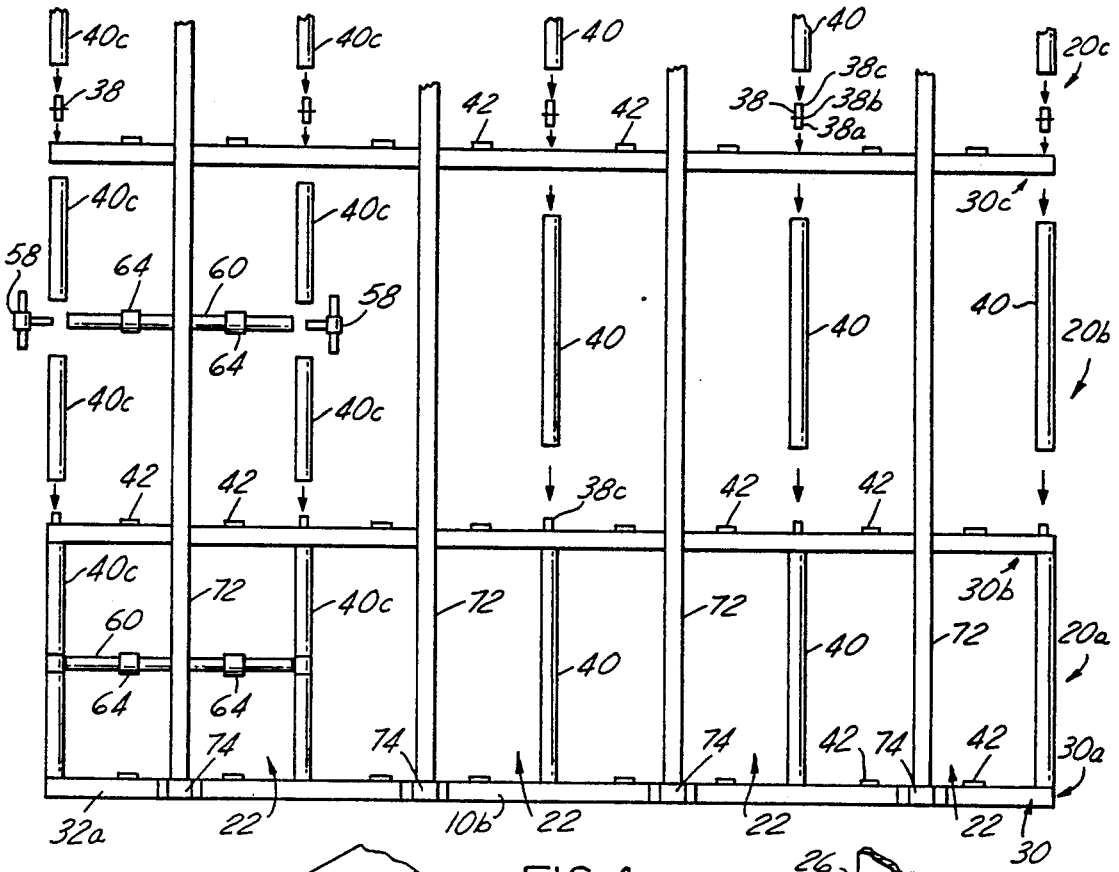
FIG. 4 is a rear view of the open-frame rack, showing the merchant access door therefor and the storied construction thereof.
Figure 5:
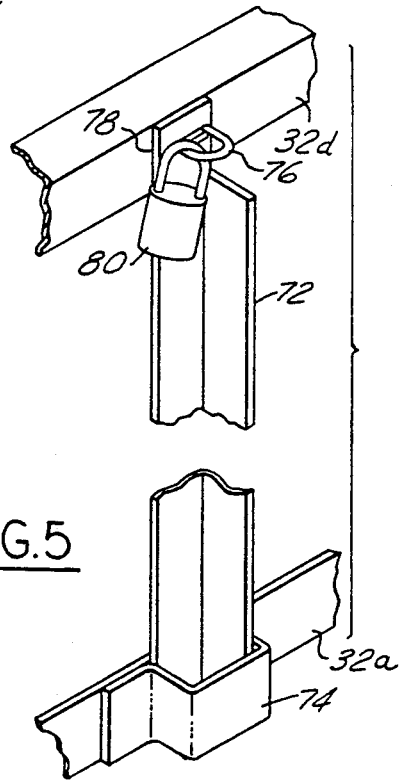
FIG. 5 is a detail, partly broken perspective view of the rear end of the open-frame rack showing the connection structure for the merchant access door.

As can be discerned from FIGS. 4 and 5, a merchant access door 72 is provided on the rear side 10*b* of the open-frame rack 10 which covers each of the compartments 22 and provides convenient access by a merchant to restock the compartments. In this regard, a U-shaped bracket 74 is connected with the first perimeter frame 32*a* and a ring 76 is connected with the fourth perimeter frame 32*d*. The merchant access door 72 is preferably constructed of angle stock with an apertured tongue 78 for receiving the ring 76. A conventional lock 80 then holds fast the merchant access door 72 when the other end thereof is in the U-shaped bracket 74.

A pair of chains 85 is preferably utilized in order to connect the fourth perimeter frame 32*d* with the first perimeter frame 32*a*. In this regard, one end of each chain 85 is connected with one of the first and fourth perimeter frames 32*a*, 32*d*, and the other end is attached to a ring connected with the other of the first and fourth perimeter frames via the conventional lock 80. This prevents would-be vandals from disassembling the open-frame rack 10.

Because an exterior placement of the open-framed rack 10 is intended, the components thereof are composed of non-corrodible materials, such as galvanized metal, aluminum or plastic. In this regard, it is preferred for the metal parts, in particular the perimeter frames, the beams and cross-beams to be plastic coated.

After constructing the open-frame rack 10 in the manner described hereinabove, the various compartments 22 are stocked, which includes the main and mezzanine portions 22*a*, 22*b* and the cells 22*c* if they are present. Now, customers can freely inspect the evergreen merchandise and then make a selection. The customer then tells the merchant which compartment holds his or her choice. After payment therefor, the merchant gives the customer a key to a key retaining key-lock 82 of the first or second customer access door 24, 26 of the selected compartment (or main or mezzanine portion, or cell thereof). The user then uses the key to open the key retaining key-lock and thereupon gain access to the desired merchandise. The customer then retrieves the prized merchandise, with no further action on the part of the merchant being necessary because the key is kept trapped in the key retaining key-lock 82.

Figure 10:
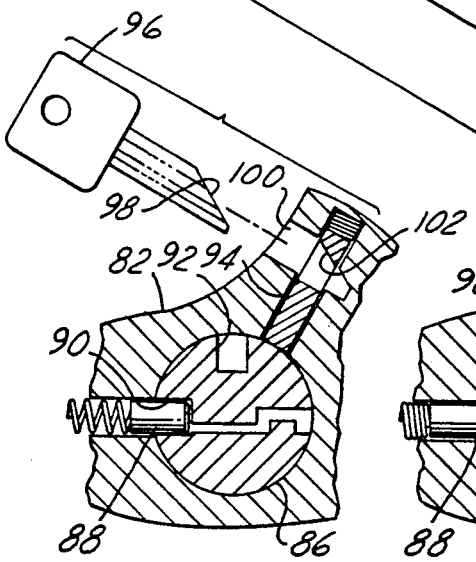
FIGS. 10 through 12 show a series of partly sectional depictions of the internal operation of the key retaining key-lock of FIG. 9.
Figure 11:
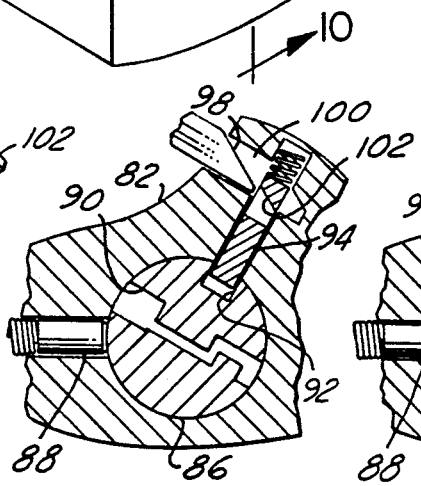
Figure 12:
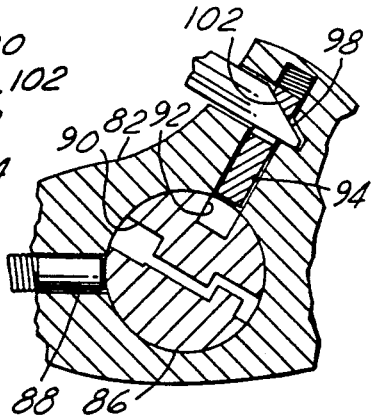
Figure 13:
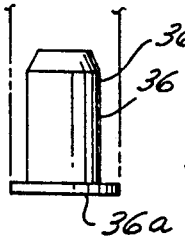
FIG. 13 is a pin for use with the bottom frame and the top frame for use with the post-and-pin construction according to the present invention.
Figure 14:
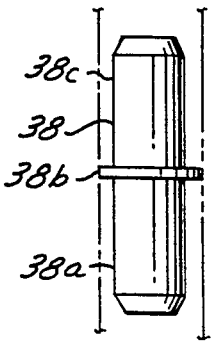
FIG. 14 is a floor frame pin for use with the post-and-pin construction according to the present invention for frames other than the bottom frame and the top frame.
Figure 16:
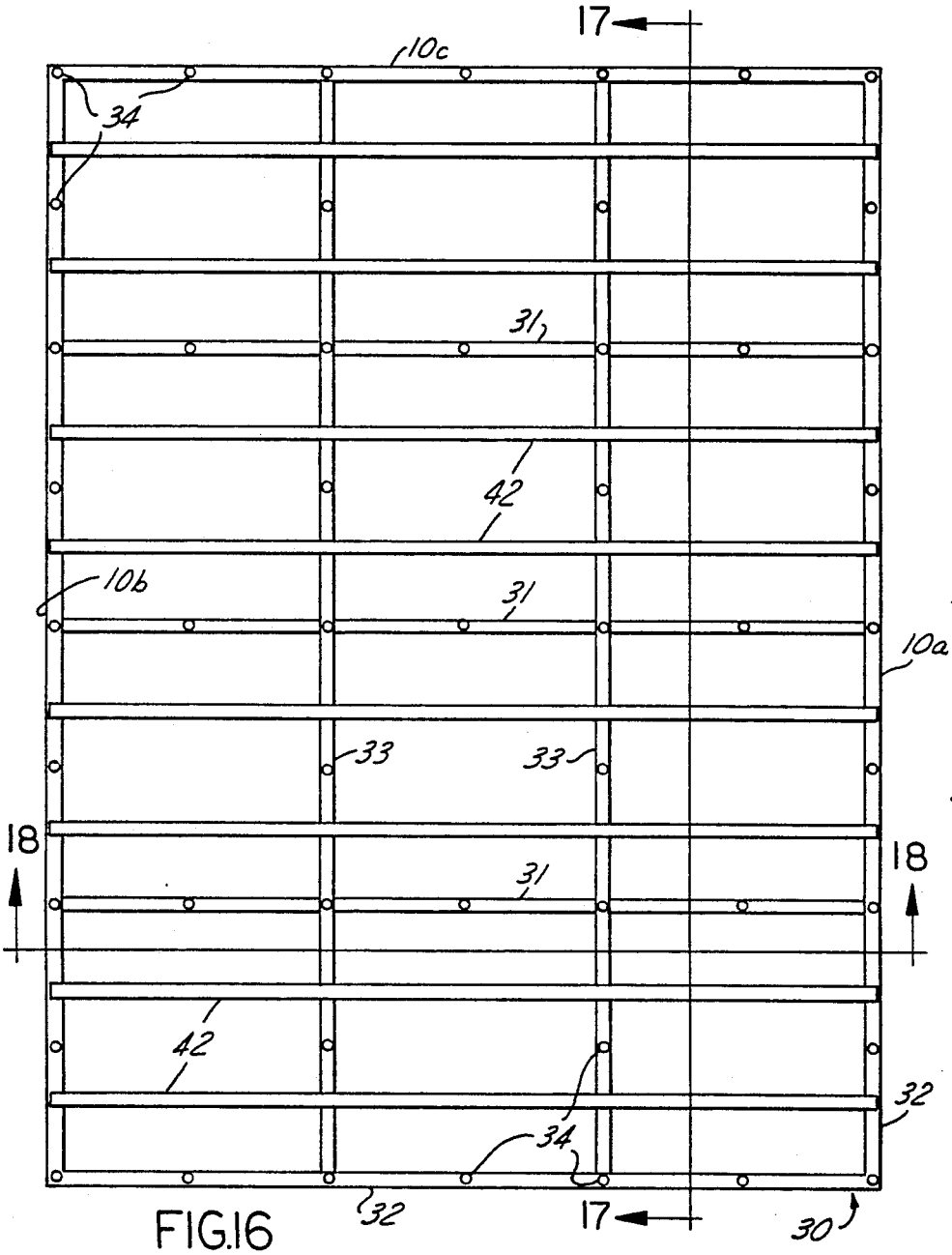
FIG. 16 is a plan view of the bottom frame according to the present invention, seen along line 16—16 in FIG. 1.
Figure 17:
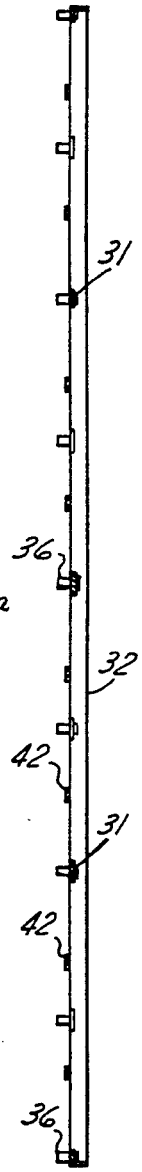
FIG. 17 is a front sectional view of the bottom frame, seen along line 17—17 in FIG. 16.
Figure 18:
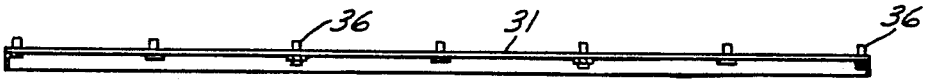
FIG. 18 is a side sectional view of the bottom frame, seen along line 18—18 in FIG. 16.

An example of a key retaining key-lock 82 which has a key trapping feature is shown in FIGS. 9 through 12. In this regard, the key retaining key-lock 82 includes a key hole 84 into which the key (not shown) is inserted in order to unlock the key retaining key-lock 82. Once unlocked, the key (not shown) is trapped in the key retaining key-lock 82. The structure to accomplish this is shown in FIGS. 10 through 12. The tumbler 86 is locked by a slot 90 into which seats a spring biased detent 88. The detent 88 is removed from the slot 90 by rotation of the key hole 84 when a key (not shown) is inserted in the key hole 84. However, a secondary slot 92 is provided on the tumbler 86 into which a secondary spring biased detent 94 is received when the key retaining key-lock 82 is in the unlocked state. The secondary detent 94 while in the secondary slot 92 prevents the tumbler 86 from rotating and thereby prevents the key (not shown) from being removed from the key hole 84. The merchant has a keyed tool 96 having a wedge shaped tip 98. The key retaining key-lock 82 is provided with an access port 100 into which the wedge shaped tip 98 is insertable. The secondary detent 94 is provided with a wedge shaped aperture 102 that is aligned with the access port when the secondary detent is received in the secondary slot 92. Accordingly, when the merchant inserts the wedge shaped tip 98 into the access port 100, the wedge shaped tip engages the wedge shaped aperture 102, thereby causing the secondary detent to be removed from the secondary slot. Now the key (not shown) can be removed from the key hole 84 because the tumbler 86 is again free to rotate.

To those skilled in the art to which this invention appertains, the above described preferred embodiment may be subject to change or mortification. For instance, the open-frame rack 10 is usable with merchandise other the aforementioned evergreen merchandise. Such change or modification can be carried out without departing from the scope of the invention, which is intended to be limited only by the scope of the appended claims.

What is claimed is:

1. An open-frame rack having at least a first story, said open-frame rack comprising:

a plurality of floors, each floor comprising:

a perimeter frame, said perimeter frame being provided with a plurality of apertures;

a plurality of beams connected with said perimeter frame, each beam of said plurality of beams being provided with a plurality of apertures;

a plurality of cross-beams connected with said perimeter frame, said cross-beams being oriented transverse with respect to said beams, each cross-beams of said plurality of cross-beams being provided with a plurality of apertures;

a plurality of runners connected with said perimeter frame, said runners being oriented parallel with respect to said beams; and a plurality of pins, a pin of said plurality of pins being insertably received in selected apertures of said plurality of apertures of said perimeter frame, said plurality of beams and said plurality of cross-beams; and a plurality of posts, each end of each post of said plurality of posts being structured to insertably receive said pins;

wherein said first story comprises:

a first floor of said plurality of floors;

selected said apertures of said first floor insertably receiving a first set of pins of said plurality of pins;

a first set of posts of said plurality of posts insertably receiving at one end thereof each pin of said first set of pins;

a second floor of said plurality of floors vertically spaced from and superimposed over said first floor;

selected said apertures of said second floor insertably receiving a second set of pins of said plurality of pins; and said first set of posts insertably receiving at the other end thereof each pin of said second set of pins to thereby define said vertical spacing between said first and second floors;

wherein each beam of said plurality of beams is positioned so as to define at least one compartment, said plurality of posts being mutually spaced a predetermined distance apart to thereby further define said at least one compartment; and wherein said at least one compartment is provided with at least one access door connected with at least one of a said post and a said perimeter frame.

2. The open-frame rack of claim 1, further comprising mezzanine floor means connected with said plurality of posts for bisecting said at least one compartment so as to provide a first portion thereof having a main floor and a second portion thereof having a mezzanine floor, each of said first and second portions of said bisected compartment being provided with a respective said access door.

3. The open-free rack of claim 2, further comprising cell means for subdividing at least one of said first and second portions of said bisected compartments into a plurality of cells; each cell of said plurality of cells being provided with a respective said access door.

4. The open-frame rack of claim 3, wherein each said access door is provided with key-lock means for selectively locking each said access door with respect to said at least one of a said post and a said perimeter frame, said key-lock means being provided with key trapping means for selectively trapping a key in said key-lock means.

5. The open-frame rack of claim 4, further comprising:

a third floor of said plurality of floors vertically spaced from and superimposed over said second floor;

selected said apertures of said third floor insertably receiving a third set of pins of said plurality of pins;

a second set of posts of said plurality of posts insertably receiving at one end thereof each pin of said second set of pins; and said second set of posts insertably receiving at the other end thereof each pin of said third set of pins to thereby define said vertical spacing between said second and third floors.

6. The open-frame rack of claim 5, further comprising:

a fourth floor of said plurality of floors vertically spaced from and superimposed over said third floor;

selected said apertures of said fourth floor insertably receiving a fourth set of pins of said plurality of pins;

a third set of posts of said plurality of posts insertably receiving at one end thereof each pin of said third set of pins; and said third set of posts insertably receiving at the other end thereof each pin of said fourth set of pins to thereby define said vertical spacing between said third and fourth floors.

7. The open-frame rack of claim 6, wherein each of said first, second and third stories is respectively comprised of a plurality of said compartments.

8. The open-frame rack of claim 7, further comprising merchant access door means connected with said first and fourth floors for providing selected access to said compartments.

9. The open-frame rack of claim 7, wherein said mezzanine floor means of each said bisected compartment comprises:

mezzanine floor support posts provided from said plurality of posts;

a plurality of mezzanine floor members connected with said mezzanine floor support posts, said plurality of mezzanine floor members including a front mezzanine floor member and a rear mezzanine floor member for each said compartment;

connector means insertably received by said plurality of mezzanine floor members and said mezzanine floor support posts for connecting mezzanine floor members to said mezzanine floor support posts; and a plurality of mezzanine runners connected with and spanning between said front and rear mezzanine floor member of each said compartment.

10. The open-frame rack of claim 9, wherein said cell means of each said bisected compartment comprises:

a plurality of cell defining posts provided from said plurality of posts, said plurality of cell defining posts insertably receiving at least one of said plurality of pins and said connector means, said plurality of cell defining posts being mutually spaced a predetermined distance apart to thereby further define each said cell.

11. The open-frame rack of claim 10, further comprising means for interconnecting said fourth floor with said first floor so as to retain said vertical spacing respectively between each said floor.

12. An open-frame rack having a plurality of stories, said open-frame rack comprising:

a plurality of floors, each floor comprising:

a perimeter frame, said perimeter frame being provided with a plurality of apertures;

a plurality of beams connected with said perimeter frame, each beam of said plurality of beams being provided with a plurality of apertures;

a plurality of cross-beams connected with said perimeter frame, said cross-beams being oriented transverse with respect to said beams, each cross-beam of said plurality of cross-beams being provided with a plurality of apertures;

a plurality of runners connected with said perimeter frame, said runners being oriented parallel with respect to said beams; and a plurality of pins, a pin of said plurality of pins being insertably received in selected apertures of said plurality of apertures of said perimeter frame, said plurality of beams and said plurality of cross-beams; and a plurality of posts, each end of each post of said plurality of posts being structured to insertably receive said pins;

wherein said plurality of stories comprises:

a first story of said plurality of stories, comprising:

a first floor of said plurality of floors;

selected said apertures of said first floor insertably receiving a first set of pins of said plurality of pins;

a first set of posts of said plurality of posts insertably receiving at one end thereof each pin of said first set of pins;

a second floor of said plurality of floors vertically spaced from and superimposed over said first floor;

selected said apertures of said second floor insertably receiving a second set of pins of said plurality of pins; and said first set of posts insertably receiving at the other end thereof each pin of said second set of pins to thereby define said vertical spacing between said first and second floors;

a second story of said plurality of stories, comprising:

a third floor of said plurality of floors vertically spaced from and superimposed over said second floor;

selected said apertures of said third floor insertably receiving a third set of pins of said plurality of pins;

a second set of posts of said plurality of posts insertably receiving at one end thereof each pin of said second set of pins; and said second set of posts insertably receiving at the other end thereof each pin of said third set of pins to thereby define said vertical spacing between said second and third floors; and a third story of said plurality of stories, comprising:

a fourth floor of said plurality of floors vertically spaced from and superimposed over said third floor;

selected said apertures of said fourth floor insertably receiving a fourth set of pins of said plurality of pins;

a third set of posts of said plurality of posts insertably receiving at one end thereof each pin of said third set of pins; and said third set of posts insertably receiving at the other end thereof each pin of said fourth set of pins to thereby define said vertical spacing between said second and third floors; and means for interconnecting said fourth floor with said first floor so as to retain said vertical spacing respectively between each said floor;

wherein each beam of said plurality of beams is positioned so as to define a plurality of compartments at each of said first, second and third stories, said first set of posts being mutually spaced a predetermined distance apart to thereby further define said plurality of compartments at said first story, said second set of posts being mutually spaced substantially said predetermined distance apart to thereby further define said plurality of compartments at said second story, and said third set of posts being mutually spaced substantially said predetermined distance apart to thereby further define said plurality of compartments at said third story; and wherein each compartment of said plurality of compartments of each of said first, second and third stories is provided with at least one access door connected with at least one of a said post and a said perimeter frame.

13. The open-frame rack of claim 12, further comprising mezzanine floor means connected with said plurality of posts for bisecting selected said compartments so as to provide a first portion thereof having a main floor and a second portion thereof having a mezzanine floor, each of said first and second portions of said bisected compartments being provided with a respective said access door.

14. The open-frame rack of claim 13, further comprising cell means for subdividing at least one of said first and second portions of said bisected compartments into a plurality of cells; each cell of said plurality of cells being provided with a respective said access door.

15. The open-frame rack of claim 14, wherein each said access door is provided with key-lock means for selectively locking each said access door with respect to said at least one of a said post and a said perimeter frame, said key-lock means being provided with key trapping means for selectively trapping a key in said key-lock means.

16. The open-frame rack of claim 15, wherein said mezzanine floor means of each said bisected compartment comprises:

mezzanine floor support posts provided from said plurality of posts;

a plurality of mezzanine floor members connected with said mezzanine floor support posts, said plurality of mezzanine floor members including a front mezzanine floor member and a rear mezzanine floor member for each said compartment;

connector means insertably received by said plurality of mezzanine floor members and said mezzanine floor support posts for connecting mezzanine floor members to said mezzanine floor support posts; and a plurality of mezzanine runners connected with and spanning between said front and rear mezzanine floor members of each said compartment.

17. The open-frame rack of claim 16, wherein said cell means of each said bisected compartment comprises:

a plurality of cell defining posts provided from said plurality of posts, said plurality of cell defining posts insertably receiving at least one of said plurality of pins and said connector means, said plurality of cell defining posts being mutually spaced a predetermined distance apart to thereby further define each said cell.

18. The open-frame rack of claim 17, wherein each said access door is provided with key-lock means for selectively locking each said access door with respect to said at least one of a said post and a said perimeter frame, said key-lock means being provided with key trapping means for selectively trapping a key in said key-lock means.

19. The open-frame rack of claim 18, further comprising merchant access door means connected with said first and fourth floors for providing selected access to said compartments.

* * * * *